US005481443A

United States Patent [19]

Wagner et al.

[11] Patent Number: 5,481,443

[45] Date of Patent: Jan. 2, 1996

[54] IN-GROUND DIRECTIONAL LIGHT FIXTURE

[75] Inventors: Lee F. Wagner, San Marcos; William A. Schulte, San Antonio, both of Tex.

[73] Assignee: The Genlyte Group, Inc., Secaucus, N.J.

[21] Appl. No.: 63,526

[22] Filed: May 19, 1993

[51] Int. Cl.[6] ..... E01F 9/00

[52] U.S. Cl. ..... 362/153.1; 362/267; 362/287; 362/372; 362/419

[58] Field of Search ..... 362/145, 364, 362/421, 365, 418, 419, 267, 372, 153.1, 153, 285, 286, 101, 437, 439, 404, 408; 220/293, 295, 298, 300

[56] References Cited

U.S. PATENT DOCUMENTS

| | | | |
|---|---|---|---|
| 2,935,601 | 5/1960 | Steiner et al. | 362/267 |
| 2,962,583 | 11/1960 | Balser | 220/300 |
| 3,096,024 | 7/1963 | Young | 362/267 |
| 3,158,327 | 11/1964 | Dameral . | |
| 3,604,921 | 9/1971 | Wood et al. . | |
| 3,745,326 | 7/1973 | Hernandez . | |
| 4,007,365 | 2/1977 | Stempfle et al. . | |
| 4,293,898 | 10/1981 | Budnovitch et al. . | |
| 4,323,954 | 4/1982 | Florence et al. . | |
| 4,342,074 | 7/1982 | Bull et al. . | |
| 4,364,108 | 12/1982 | Rapp . | |
| 4,445,163 | 4/1984 | Ziaylek, Jr. | 362/267 |
| 4,447,859 | 5/1984 | Raczynski . | |
| 4,458,301 | 7/1984 | Chapman et al. . | |
| 4,503,486 | 3/1985 | Makita . | |
| 4,527,224 | 7/1985 | Sangiamo et al. . | |
| 4,533,984 | 8/1985 | Gatton . | |
| 4,561,203 | 12/1985 | MacDonald, Jr. et al. . | |
| 4,568,155 | 2/1986 | Shimiza . | |
| 4,621,307 | 11/1986 | Weber . | |
| 4,661,893 | 4/1987 | Robinson | 362/267 |
| 4,675,794 | 6/1987 | Fink, Jr. et al. . | |
| 4,697,950 | 10/1987 | Copeland . | |
| 4,742,818 | 5/1988 | Hughes et al. . | |
| 4,760,511 | 7/1988 | Russello et al. . | |
| 4,797,797 | 1/1989 | Collot et al. . | |
| 4,812,703 | 3/1989 | Kanematsu et al. . | |
| 4,832,425 | 5/1989 | Walther et al. . | |
| 4,835,667 | 5/1989 | Wolfe . | |
| 4,870,548 | 9/1989 | Beachy et al. . | |
| 4,881,152 | 11/1989 | Watanabe et al. . | |
| 4,890,903 | 1/1990 | Treisman et al. . | |
| 4,907,139 | 3/1990 | Quiogue . | |
| 4,930,054 | 5/1990 | Krebs . | |
| 4,931,915 | 6/1990 | Quiogue | 362/153.1 |
| 4,947,307 | 8/1990 | Quiogue . | |
| 4,972,301 | 11/1990 | Kasboske . | |
| 4,992,914 | 2/1991 | Heiss et al. . | |
| 4,999,757 | 3/1991 | Poppenheimer | 362/287 |
| 5,003,436 | 3/1991 | Yamada et al. . | |
| 5,015,917 | 5/1991 | Nigg . | |
| 5,016,151 | 5/1991 | Mula . | |
| 5,041,950 | 8/1991 | Tyson | 362/153.1 |

(List continued on next page.)

OTHER PUBLICATIONS

"Complaint for Patent Infringement; Demand for Jury Trial" of GTY Industries.

*Primary Examiner*—James C. Yeung
*Attorney, Agent, or Firm*—Vaden, Eickenroht, Thompson & Feather

[57] ABSTRACT

A light fixture for directional, illumination is disclosed. A first embodiment contains a gimbal comprised of two opposing retaining collars with arcuately complementary surfaces which mate to the arcuate surface of the lamp/reflector assembly within the fixture housing. The fixture housing is sealed with a rotatable lens ring which radially compresses a sealing element when mounted to the fixture with a lens-frame. The lamp/reflector assembly is sealed by compressing a sealing element between a lens and the assembly body by camming a lens frame onto the body with a plurality of inclined planes acting on buttons from the body. A second embodiment includes a flexure hinge within the assembly body. Some embodiments include a square to round adapter for use where square fixtures are desired.

16 Claims, 4 Drawing Sheets

U.S. PATENT DOCUMENTS 5,055,980 10/1991 Mochizuki .
5,055,987 10/1991 Ellson et al. .
5,060,127 10/1991 Birt .
5,070,434 12/1991 Suman et al. .
5,084,809 1/1992 Bogdanovs .
5,117,342 5/1992 Vlah .
5,134,557 7/1992 Gordin et al. .
5,150,172 9/1992 Brierley .
5,150,958 9/1992 Miyazawa et al. .
5,156,788 10/1992 Chesterfield et al. .
5,158,352 10/1992 Ikegami et al. .
5,160,202 11/1992 Legare .
5,161,876 11/1992 Smith .
5,161,883 11/1992 Gordin et al. .
5,171,085 12/1992 Jaksich .
5,230,559 7/1993 Porter et al. ..... 362/153.1

IN-GROUND DIRECTIONAL LIGHT FIXTURE

BACKGROUND OF THE INVENTION

1. Field of the Invention

The present invention pertains to illumination and, more particularly, to exterior directional lighting.

2. Description of the Prior Art

In-ground directional light fixtures encounter problems not typically found in the larger field of general illumination. One of the most important problems is the intrusion of water and other electrically conductive fluids. A second problem is the need to control the direction of illumination with maximum efficiency from below the ground surface where the lamp is typically located.

A number of sealing techniques have been employed by the prior art. One approach has been to seal the entire fixture in which the lamp is placed. Another approach has been to allow electrically conductive fluid within the fixture housing, but to seal the various electrical components and connections within the housing from the fluid. Regardless of the approach, the use of these sealing techniques usually creates difficulty during assembly.

The principal cause of assembly difficulties is that, by definition, sealing mechanisms create large amounts of friction between various parts of the assembly. This typically requires that interacting elements of the various parts be aligned when fitted together to minimize relative movement that may damage the sealing element. While this may not necessarily be difficult, it is tedious and tiresome and can slow assembly time, particularly where assembly is not highly automated.

The problem of controlling the direction of illumination is equally vexing but problems arise during use rather than assembly. The chief problem arises because the lamp is typically located beneath the ground surface, thereby limiting the range of illumination and convenient access to the lamp. Prior art efforts at directional lighting usually provide for a lamp to rotate about one or more axes of rotation defined by a points about which the lamp or an arm from which the lamp is suspended pivots, although sometimes cams are employed. However, such an approach requires an ever increasing number of axes to achieve greater freedom of movement which is always desirable in directional lighting.

It is therefore a feature of this invention that it provides a sealing mechanism for an in-ground light fixture which will facilitate assembly of the fixture.

It is furthermore a feature of this invention that it maximizes freedom of movement for the lamp with convenient access thereto for greater directional control.

SUMMARY OF THE INVENTION

The invention is a light fixture that includes a gimbal comprised of two opposing retaining members with arcuately complementary surfaces that mate to the arcuate surfaces of the lamp/reflector assembly within the fixture housing. The fixture housing is sealed with a radial seal created by radially compressing a sealing element between the lens and the fixture housing. The lamp/reflector assembly is sealed by compressing a sealing element between a lens and the assembly body by camming a lens; frame onto the body with a plurality of recesses including inclined planes acting on buttons from the assembly body. An alternative embodiment includes a flexure hinge and seals only the assembly body. Some embodiments also include a square to round adaptor for use where square fixtures are desired.

DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail, The drawings illustrate only preferred embodiments of the invention and are not to be considered limiting of its scope as the invention will admit to other equally effective embodiments. In the drawings.

DESCRIPTION OF THE PREFERRED EMBODIMENT

Figure 1:
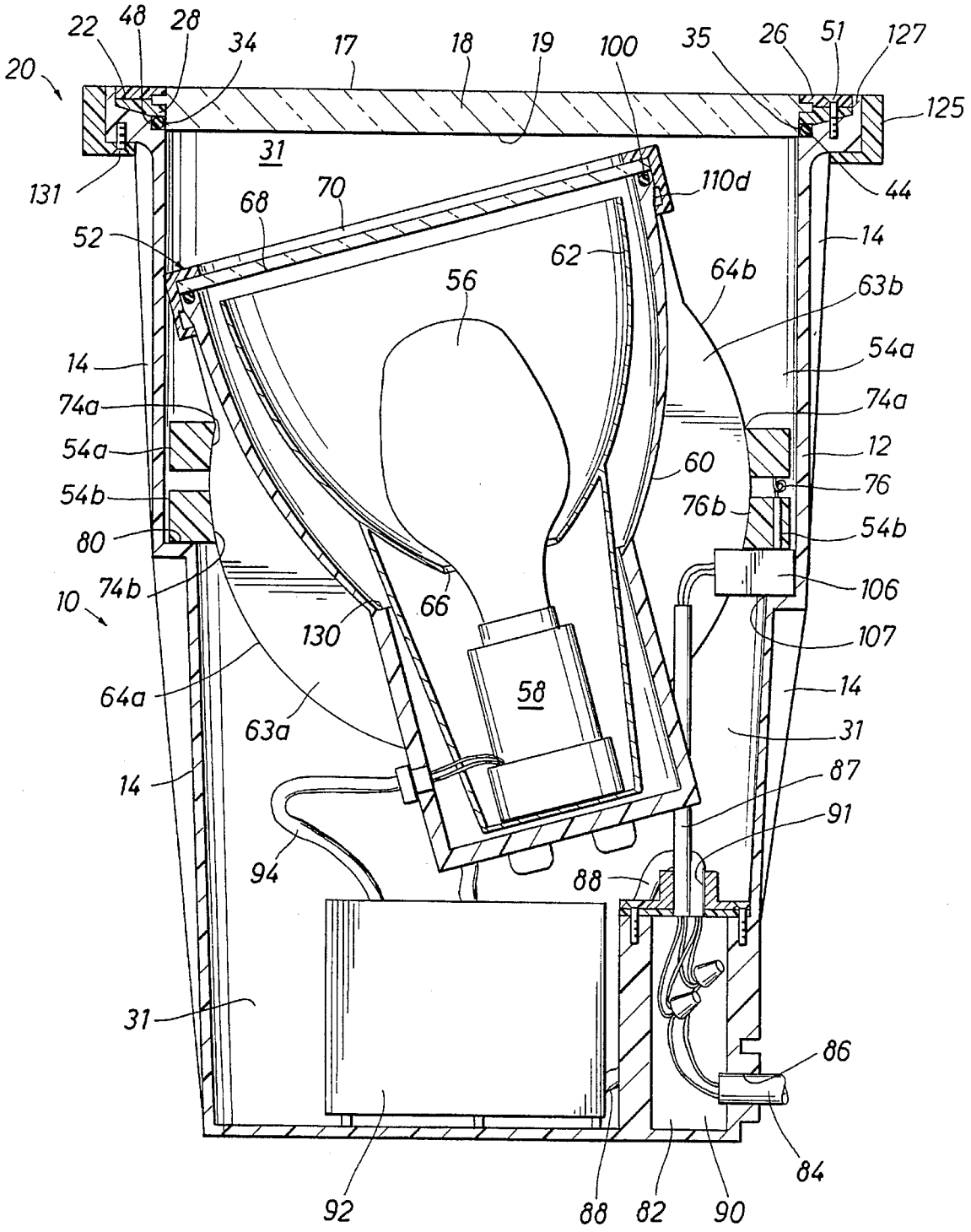
FIG. 1 is an elevational, vertical cross-sectional illustration of the preferred embodiment of the present invention.

The preferred embodiment of the invention is illustrated in FIG. 1. Fixture 10 generally comprises lens assembly 20 mounted to housing 12 in a manner hereafter described. Housing 12 in the preferred embodiment is substantially circular in horizontal cross-section and has a plurality of vertical exterior fins 14 substantially about all the outer circumference of housing 12. Exterior fins 14 of the preferred embodiment provide structural support to housing 12 for bearing vertical loads such as an automobile driving over the top of fixture 10 when installed in-ground. Fixture 10 receives electrical power from an external source (not shown) as described below.

Figure 2:
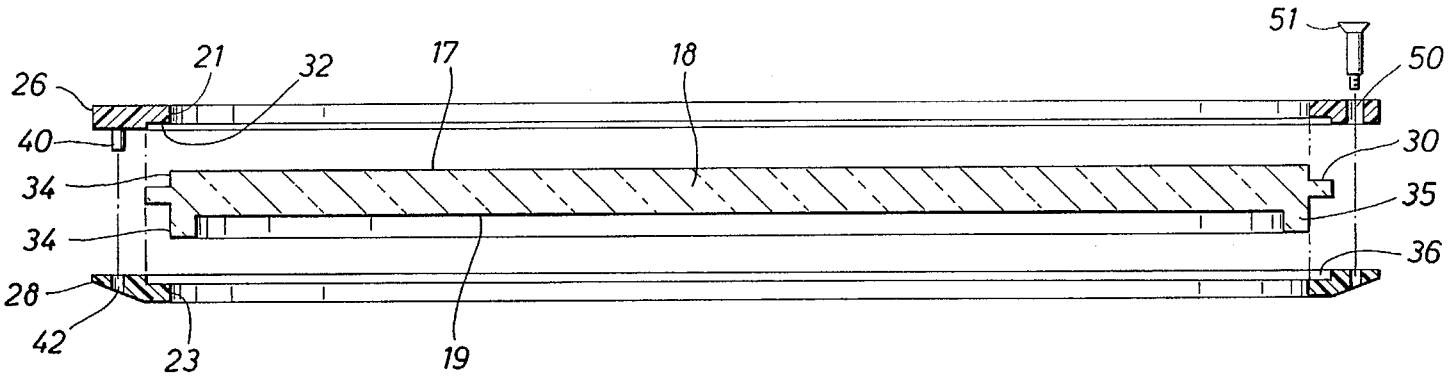
FIG. 2 is an exploded view of the lens assembly as shown in FIG. 1.

Lens assembly 20 is shown in FIGS. 1–2 and includes lens 18 sealably mounted to housing 12 by lens frame 22 to cover the opening (not numbered) in the end of housing 12 defined by lip 127. Lens frame 22 functions as a retaining ring and is formed by top member 26 and bottom member 28, top member 26 being heat staked and bonded to bottom member 28 at a plurality of points in the preferred embodiment. The bonding agent (not shown) may be any one of several commonly known to those in the industry and provides structural strength to lens frame 22 when assembled. When top member 26 is heat staked to bottom member 28 as shown in FIG. 1, lens frame 22 created thereby is loosely mounted to lip 30 projecting from edge 34 of lens 18 by the recess 36 formed in the joint between top member 26 and bottom member 28 by recess 32 in top member 26 and recess 36 bottom member 28.

During assembly, top member 26, bottom member 28, and lens 18 are inverted, or turned "upside down". Lens 18 is then placed in top member 26 such that lip 30 rests in recess 32 of top member 26. Bottom member 28 is then fitted over flange 35 of lens 18 until recess 36 rests atop lip 30. As bottom member 28 is lowered over flange 35, stake 40 projecting from top member 26 snap fits into opening 42 in bottom member 28 to secure top member 26, bottom member 28, and lens 18 together.

A plurality of stakes and openings such as stake 40 and opening 42 are spaced apart and snap fit together around substantially all the periphery of top member 26 and bottom member 28. The entire circumference of top member 26 must be firmly supported during the snap fit process to maintain complete contact about the entire circumference and eliminate gaps between the contacting surfaces top member 26 and bottom member 28. Such gaps are considered cosmetic defects and are commercially undesirable although they do not detract from the function of lens frame 22.

The intermediate assembly composed of top member 26, bottom member 28 and lens 18 is then uprighted. As shown in FIG. 1, flange 35 of lens 18 extends below bottom member 28 when bottom member 28 is heat staked to top member 26 to form lens frame 22. Sealing element 44, an O-ring in the preferred embodiment, is then stretched across and around the outer diameter of flange 35 and positioned on flange 35 below bottom member 28 of lens frame 22. Once lens frame 22 is fully assembled, first lens surface 17 of lens 18 is circumscribed by perimeter 21 of top member 26 and second lens surface 19 is circumscribed by perimeter 23 of bottom member 28 as shown in FIG. 1.

The intermediate assembly of top member 26, bottom member 28, lens 18, and sealing element 44 is then set on seat 48 of housing 12. Top member 26 and bottom member 28 freely rotate about lens 18 on lip 30 without damaging sealing element 44 even though a seal is partially effected between edge 34 of flange 35 of lens 18 and seat 48 of housing 12. Lens frame 22 can therefore be rotated until openings 50 are aligned with similarly spaced openings (not shown) in housing 12 and, upon alignment, threaded screw 51 is inserted through opening 50 to secure the intermediate assembly to housing 12. As the screws are rotated, sealing element 44 is radially compressed to complete the seal between housing 12 and lens 18. Sealing element 44 therefore remains undamaged even though the intermediate assembly is moved relative to housing 12 while sealing element 44 is in place because lens frame 22 freely rotates about lip 30 of lens 18 until the intermediate assembly is secured to housing 12.

The preferred embodiment as illustrated in FIG. 1 also includes a means for gimbaling lamp reflector assembly 52 within interior 31 of housing 12. The gimbaling means and lamp reflector assembly 52 together constitute a means for directionally emanating light from within interior 31 of housing 12 through (a) the opening therein (not numbered), and (b) lens 18 covering the housing opening, to provide illumination through approximately 15° of circular rotation from center. Assembly 52 includes lamp 56 installed in socket 58 mounted to reflector 62 in interior 65 of assembly body 60 such that lamp 56 extends from socket 58 through aperture 66.

Interior 65 of assembly body 60 comprises a first section generally parabolic in shape to accommodate the substantially parabolic shape of reflector 62 and a second section generally frusto-conical in shape in which lamp 56 and socket 58 are mounted. However, these shapes may be variable as will be recognized by one of ordinary skill in the art having the benefits of the teachings herein. The opening (not numbered) in assembly body 60 at one end thereof is closed by lens 68 and assembly cover 70, lens 68 being held in place by assembly cover 70 in a manner hereafter described. Upon lamp 56 receiving power, light from lamp 56 emanates from interior 65 of assembly body 60 through the assembly opening therein and lens 68 as well as from interior 31 of housing 12, the housing opening therein, and lens 18.

Figure 3A:
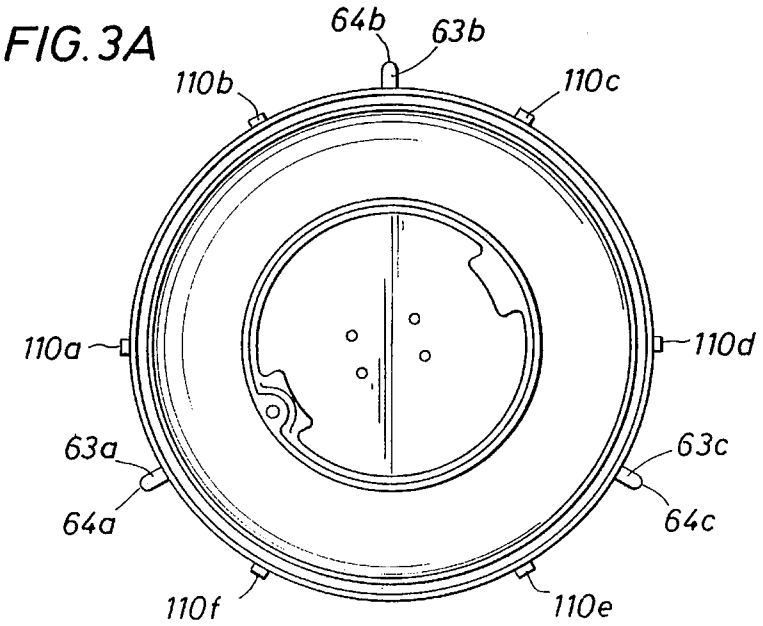
FIG. 3A is a plan view of the lamp/reflector assembly body of the embodiment shown in FIG. 1.

The exterior of the midsection of assembly body 60 includes a plurality of fins 63*a–c* having outer arcuate surfaces 64*a–c*, fins 63*a–c* being spaced 120° apart as shown in FIG. 3A. Each of fins 63*a–c* extends radially from the exterior surface of assembly body 60 and, in the preferred embodiment, is arcuate in both horizontal and vertical directions relative to the ground surface. Those of ordinary skill in the art having the benefits of the teachings herein will recognize that only two of fins 63*a–c* are necessary to practice the invention and that fins 63*a–c* can be replaced by a single arcuate surface forming a band ringing the exterior of assembly body 60.

Figure 3:
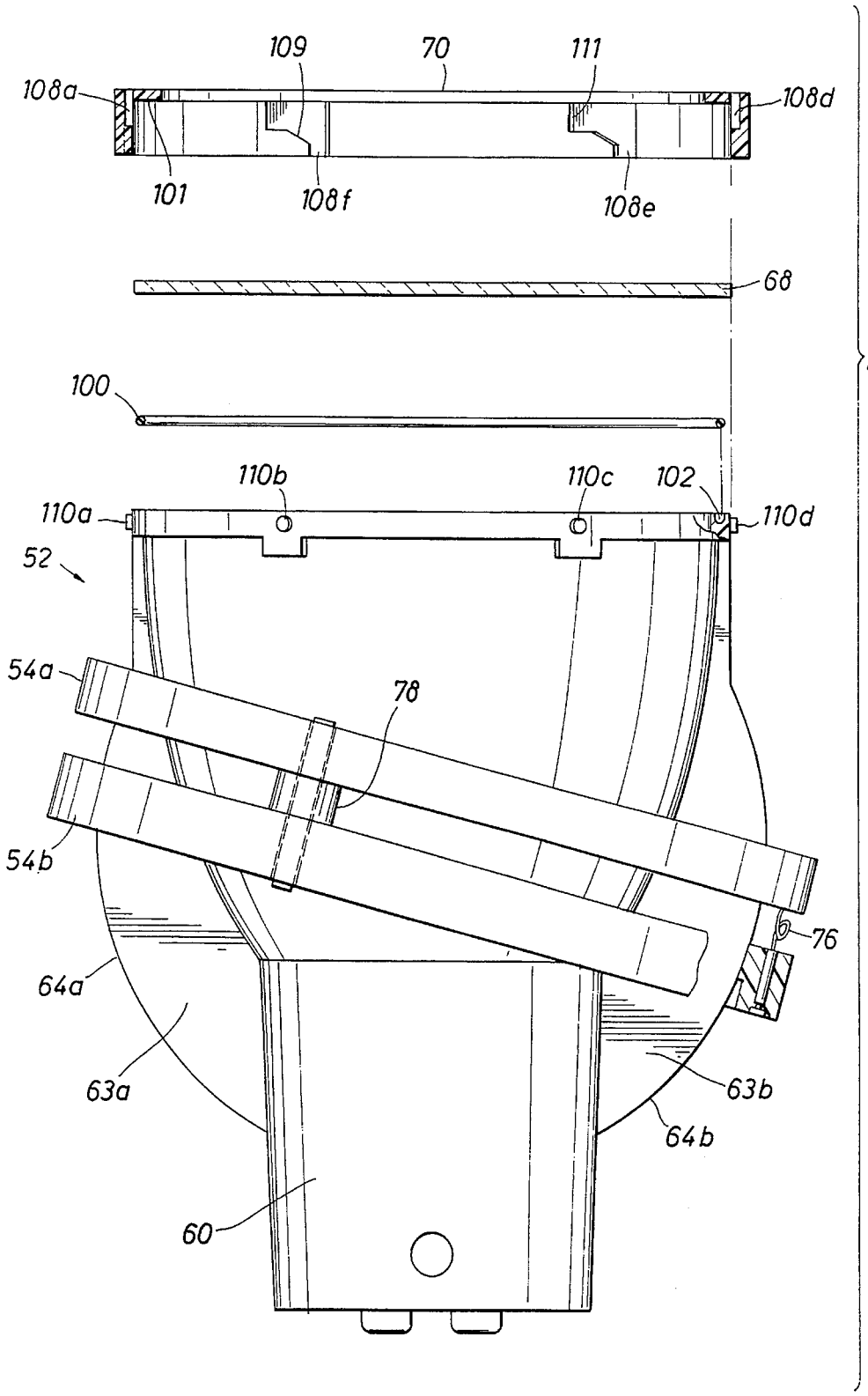
FIG. 3 is an exploded view of the lamp/reflector assembly in FIG. 1 and its sealing mechanism.

Retaining members 54*a–b* are mounted to the interior of housing 12 by resting retaining member 54*b* on shoulder 80 formed in the inside wall of housing 12 where it remains through the force of gravity as shown in FIG. 1. Retaining members 54*a–b* are opposing ring collars and have downwardly and upwardly facing, arcuately complementary, surfaces 74*a–b*, respectively, which mate to arcuate surfaces 64*a–c* of fins 63*a–c* extending radially from the midsection of assembly body 60. As shown in FIG. 3, retaining members 54*a–b* are spaced apart by bracket 78. Biasing element 76, a spring in the preferred embodiment, provides tension between retaining members 54*a–b*, thereby introducing controlled friction between arcuate surface 64*a–c* of fins 63*a–c* and mating surfaces 74*a–b* of retaining members 54*a–b*. This impedes free rotation of assembly body 60 which might otherwise result from a variety of sources, such as ground vibration caused by proximal vehicular traffic.

Assembly 52 is consequently suspended within housing 12 when placed between retaining members 54*a–b* by virtue of the interaction of arcuately complementary surfaces 74*a–b* of retaining members 54*a–b*, respectively, and arcuate surfaces 64*a–c* of assembly body 60. Biasing element 76 provides tension between retaining members 54*a–b*, which applies friction through the arcuate surface 74*a–b* to arcuate surfaces 64*a–c* of assembly body 60 to resist free motion of assembly 52 arising from external forces such as vibration while allowing circular rotation through 15° about a neutral or central axis. When supplied with power, lamp 56 of assembly 52 emanates light from out of the interior of assembly body 60 through the opening therein and from out of the interior of housing 12 through the opening therein through the full range of motion.

Referring now to FIGS. 3 and 3A, a water tight seal for assembly 52 is effected by compressing sealing element 100, an 0-ring in the preferred embodiment, in recess 102 formed in lip 67 of assembly body 60 beneath lens 68 with interior surface 101 of assembly cover 70 which functions as a lens frame. Sealing element 100 is first placed in recess 102 and then lens 68 is set on top of assembly body 60. Assembly cover 70 is then rotated to align recesses 108*a–f* with buttons 110*a–f* spaced about the outer diameter of assembly body 60 as shown in FIG. 3A.

Each of recesses 108*a–e* includes an offset, inclined, planar, surface such as surface 109 of recess 108*f* shown in FIG. 3. Assembly cover 70 is mounted to assembly body by mating buttons 110*a–f* with the openings to recesses 108*a–f* and simultaneously rotating assembly cover 70 in a clockwise direction. Each of buttons 110*a–f* will bear across the planar surface of recesses 108*a–f*, respectively, until contacting the end wall of the recess, such as end wall 111 of recess 108*e*. This interaction between buttons 110*a–f* and recesses 108*a–f* cams assembly cover 70 tightly against assembly body 60, thereby compressing sealing element 100 in recess 102 to effect the seal. The sealing mechanism just described can furthermore be combined with the mechanism previously discussed to provide a seal through both radial and circumferential compression.

As shown in FIG. 1, fixture 10 includes means for delivering power to lamp 56 from a power source (not shown) external to fixture 10. Housing 12 includes electrical connection chamber 82 formed therein through which lamp 56 receives power via line 84 and fluidly sealed port 86. Line 84 is electrically connected to line 88 which exits electrical connection chamber 82 through aperture 91 to provide power to ballast 92 of lamp 56. Aperture 91 is designed to prevent wicking and passage of moisture using techniques readily known to those in the art.

Power from ballast 92 is transmitted to lamp 56 via line 94 which enters assembly body 60. Even though both housing 12 and assembly 52 are sealed in the preferred embodiment, the electrical components within housing 12 are insulated from electrically conductive fluids. Electrical connection chamber 82 in the preferred embodiment shown in FIG. 1 includes sealing element 85 for just such a purpose.

The preferred embodiment also includes pressure sensitive microswitch 106 (shown in FIG. 1) that provides a failsafe power shutoff. Switch 106 is positioned on surface 107 created by a notch in shoulder 80 and projects slightly above shoulder 80. Thus, when assembly body 60 and retaining members 54*a–b* are mounted in housing 12, switch 106 is compressed between retaining member 54*b* and surface 107. Switch 106 is wired between ballast 92 and the power source not shown via line 87. Line 87 is wired to lines 84 and 88 in electrical connection chamber 82, line 87 entering chamber 82 via port 91, as shown. Power is switched on as long as switch 106 senses pressure from retaining member 54*b* and is switched off when no pressure is sensed by switch 106. Thus, when assembly body 60 and retaining members 54*a–b* are raised, such as during installation maintenance, power to lamp 56 is turned off to help prevent electrical shock to people working on fixture 10.

Figure 4:
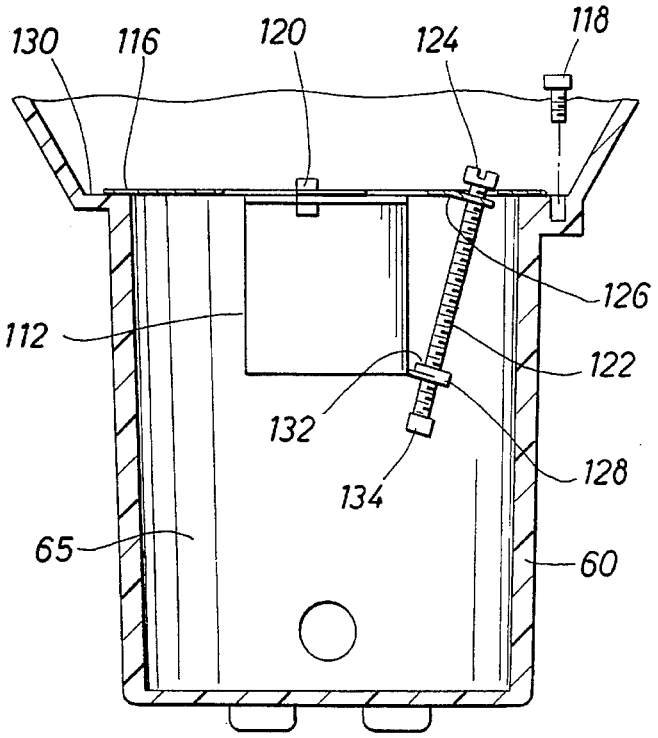
FIG. 4 is a vertical sectional illustration of an alternative embodiment of the present invention utilizing a flexure hinge.
Figure 4A:
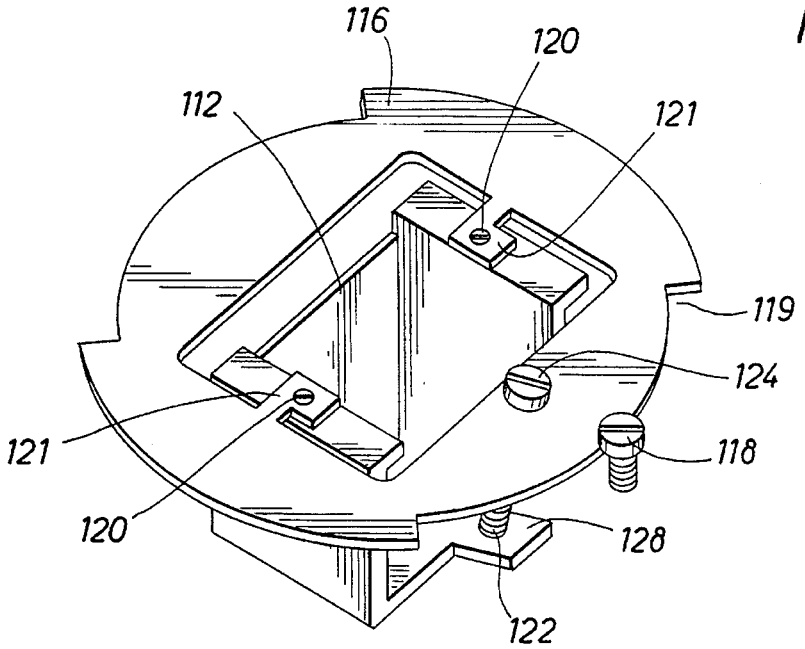
FIG. 4A is an elevational, perspective view of the flexure hinge of FIG. 4.

An alternative embodiment incorporating a flexure hinge instead of or in addition to the gimbaling means of FIGS. 1, 3, and 3A is illustrated in FIGS. 4 and 4A. However, not all parts of fixture 10 are shown for the sake of clarity. Lamp 56, socket 58, and reflector 62 (shown only in FIG. 1), are mounted in receptacle 112 of FIG. 4 in a manner well known in the art. Receptacle 112 is mounted in assembly body 60 by bracket 116 secured to shoulder 130 in interior 65 of assembly body 60 by screw 118.

Receptacle 112 is secured to ring bracket 116 by rivets 120 to a pair of aligned pivots formed by flexure hinge elements 121 of ring bracket 116 and via screw assembly 122. Threaded member 124 is inserted through, without threadably engaging ring bracket 116, opening 126 in bracket 116. Member 124 also passes through and is threadably engaged to receptacle 112 at opening 128 in flange 132 of receptacle 112 and has cap 134 mounted to the terminus thereof. Cap 134 prevents the terminus of member 124 from passing through opening 128 when member 124 is rotated counterclockwise.

As threaded member 124 is rotated counterclockwise, the threaded engagement between member 124 and opening 128 and cap 134 translate the rotational action of member 124 to a rotational moment for receptacle 112. This translation causes receptacle 112 to rotate counterclockwise about the axis defined by flexure hinge elements 121. Clockwise rotation of receptacle 112 similarly occurs upon clockwise rotation of threaded member 134 and allows receptacle 112 to assume the original position relative to assembly body 60. Thus, as receptacle 112 rotates, lamp 56, socket 58, and reflector 62 (shown only in FIG. 1) tilt about the axis defined by flexure hinge elements 121.

This flexure hinge arrangement allows rotation about the axis defined by flexure hinge elements 121 through a range of approximately +/–45° from the vertical axis within assembly body 60. Rotation of approximately +/–15° about a second axis can be achieved by loosening screw 118, rotating bracket 116 throughout the length of slot 119 in bracket 116, and retightening screw 118. Notably, in this embodiment, housing 12 is not sealed in the manner shown in FIGS. 1–2 although assembly body 60 is sealed as shown in FIGS. 1 and 3. If an alternative embodiment employs the flexure hinge illustrated in FIGS. 4 and 4A without the gimbaling means illustrated in FIGS. 1, 3, and 3A, assembly body 60 may be secured directly to shoulder 80 in interior 31 of housing 12 by any means which will be apparent to those of ordinary skill in the art having the benefit of the teachings herein.

Figure 5:
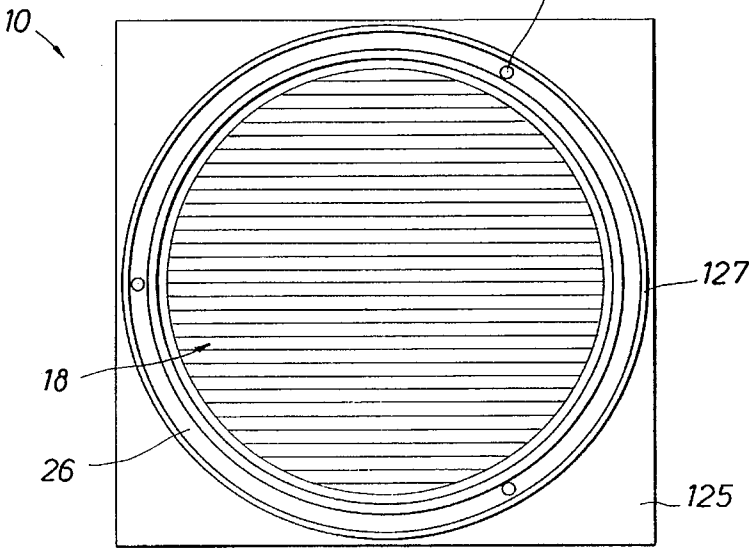
FIG. 5 is a plan view of the embodiment of FIG. 1 illustrating a round-to-square adapter for adapting the substantially round housing of the preferred embodiment for uses where square fixtures are preferred.

Returning to FIG. 1 and also referring to FIG. 5, fixture 10 may be adapted for applications where square fixtures, as opposed to round, are desired. As noted previously, housing 12 of fixture 10 is generally circular in horizontal cross-section and has lip 127 thereabout at the uppermost end. Adapter 125 has a circular recess whose diameter is only slightly greater than the outer diameter of housing 12 at lip 127, the recess being substantially centered in adapter 125.

Adapter 125 also has a circular opening concentric with the recess, the opening having a diameter less than the recess opening but slightly larger than the outer diameter of housing 12. The recess and the opening thereby define an edge about the opening within the recess. The edge furthermore has a plurality of holes about the perimeter thereof.

Adapter 125 and housing 12 are assembled by dropping housing 12 through the circular opening of adapter 125 from bottom to top until the edge around the opening in adapter 125 rests against the undersurface of lip 127 of housing 12. Adapter 125 is then secured to the undersurface of lip 127 at a plurality of points by screws such as screw 131 shown in FIG. 1 through holes in the edge about the opening.

Because the recess diameter and the opening diameter are only slightly larger than the diameter of lip 127 and housing 12, respectively, there is a snug fit between adapter 125 and fixture 10. The opening diameter cannot be any greater than the outer diameter of lip 127 and must be greater than the outer diameter of housing 12 just below lip 127. Likewise, the recess diameter can be no smaller than the outer diameter of lip 127. The edge defined by the recess and opening diameters must furthermore be of sufficient width to structurally support the weight of fixture 10.

From the foregoing it will be seen that this invention is one well adapted to attain all of the ends and objects previously set forth, together with other advantages which are obvious from the teachings herein and which are inherent to the apparatus. For example, lens 18 is shown to be planar but may instead be convex. Also, many types of lamps may be substituted for lamp 56 shown in FIG. 1. Top member 26 and bottom member 28 of lens frame 22 may also be joined by a plurality of threaded fasteners instead of the bonding and heat staking process previously described. There are many other such minor variations of the preferred embodiment disclosed herein.

As many possible embodiments may be made of the invention without departing from the scope thereof, it is to be understood that all matter-herein set forth or shown in the accompanying drawings is to be interpreted as illustrative and not in a limiting sense. Furthermore, it will be understood that some features and subcombinations are of utility and may be employed without reference to other features and subcombinations. This is contemplated by and is within the scope and spirit of the claimed invention.

What is claimed is:

1. A light fixture, comprising:

an in-ground housing having an interior and an opening;

an assembly gimbaled in the housing interior, the assembly including:

a body having an interior, an opening, an arcuate outer surface; and a lamp mounted in the body interior;

means for gimbaling the assembly mounted within the housing interior to provide rotation about a plurality of axes and including a pair of retaining members having arcuately complementary surfaces that mate to the arcuate outer surface of the body to suspend the assembly within the housing; and means for providing electrical power to the lamp.

2. A light fixture, comprising:

a housing having an interior and an opening;

an assembly gimbaled in the housing interior, the assembly including:

a body having an interior, an arcuate outer surface and an opening; and a lamp mounted in the body interior emanating light through the housing opening and assembly opening upon receiving electrical power;

a pair of retaining members mounted in the housing interior, the retaining members having arcuately complementary surfaces that mate to the outer surface of the body to suspend the assembly within the housing; and means for providing electrical power to the lamp.

3. The light fixture of claim 2, wherein the housing includes a shoulder projecting therefrom within the interior to which one of the retaining members is mounted.

4. The light fixture of claim 2, wherein the assembly includes a reflector behind the lamp within the body interior.

5. The light fixture of claim 2, wherein one of the retaining members is biased apart from and bracketed to the second retaining member.

6. The light fixture of claim 2, wherein a lens sealably covers any one of the housing and the assembly.

7. The light fixture of claim 2, wherein the arcuate outer surface is comprised of at least two arcuate surfaces on fins extending radially from the assembly body.

8. A seal for an opening in a body of a light fixture, comprising:

a lens having a first lens surface, a second lens surface, an edge about substantially all the perimeter thereof, and a lip projecting from the edge;

a lens ring secured to the body comprising:

a first ring member having a first hole therethrough and a first recess about the perimeter of the first hole; and a second ring member having a second hole therethrough and a second recess about the perimeter of the second hole, the second recess being aligned with the first recess to form a slot encasing the lip of the lens such that the perimeter of the first hole circumscribes the first lens surface and the perimeter of the second hole circumscribes the second lens surface; and a sealing element radially compressed between the edge of the lens and the body by the securement of the lens ring to the housing.

9. The seal of claim 8, wherein the fixture body is a housing and the opening is in the housing.

10. The seal of claim 8, wherein the fixture includes a plurality of buttons extending from the fixture about the opening and wherein a lens frame is secured by:

aligning plurality of recesses in the lens frame having inclined planes with the plurality of buttons;

fitting the recesses over the buttons; and rotating the lens frame to cam the lens frame onto the fixture and circumferentially compress the sealing element between the lens ring and the fixture.

11. A seal for an opening in the body of a light fixture, comprising:

a plurality of buttons extending from the fixture body about the opening;

a lens having a first lens surface, a second lens surface, an edge about substantially all the perimeter thereof, and a lip projecting from the edge;

a sealing element between the lens and the fixture;

a lens frame secured to the fixture, the lens frame having a hole therein, the perimeter of the hole circumscribing the lens, and being secured by:

aligning a plurality of recesses having inclined planes formed therein with the plurality of buttons, fitting the recesses over the buttons, add rotating the lens frame to cam the lens frame onto the fixture body and circumferentially compress the sealing element between the lens and the fixture body;

a lens ring encasing the lens and radially compressing the sealing element when secured to the fixture body by the lens frame, the lens ring comprising:

a first ring member having a first hole therethrough and a first recess about the perimeter of the first hole; and a second ring member having a second hole therethrough and a second recess about the perimeter of the second hole, the second recess being aligned with the first recess to form a slot encasing the lip of the lens such that the perimeter of the first hole circumscribes the first lens surface and the perimeter of the second hole circumscribes the second lens surface.

12. A gimbaled, in-ground lighting fixture for directional illumination comprising:

a housing for mounting in the ground the housing having an interior and an opening;

means for directionally emanating light through the housing opening the emanating means being mounted within the interior of the housing below ground surface protected against intrusion of electrically conductive fluid, and rotatable about a plurality of axes, the emanating means including an assembly further including:

a body having an arcuate outer surface and an opening; and a lamp mounted in the body emanating light through the housing opening and the assembly body opening upon receiving electrical power; and a pair of retaining members mounted in the housing interior, the retaining members having arcuately complementary surfaces which mate to the outer surface of the body to suspend the assembly within the housing;

means for providing electrical power to the emanating means, said means being protected from the intrusion of electrically conductive fluid.

13. The fixture of claim 12, wherein the lens sealably covers the second opening.

14. A method for gimbaling a lamp within a housing of a light fixture, comprising the steps of:

mounting a first retaining member having an upwardly-facing, arcuate, innermost surface to the interior of the housing;

setting a body on the first retaining member, the body having a light source mounted therein and an arcuate outer surface for mating with the innermost surface of the first retaining member;

setting a second retaining member having a downwardly-facing, arcuate, innermost surface on the body, the downwardly-facing innermost surface being arcuately complementary to the upwardly-facing innermost surface of the first retaining member and mating with the arcuate outer surface of the body; and maintaining the position of at least a portion of the second retaining member within a fixed distance relative to the first retaining member.

15. The method of claim 14, wherein the step of maintaining the position of the second retaining ring includes permitting change in the position of the second retaining member relative to the first retaining member within the fixed distance.

16. The method of claim 14, wherein the step of maintaining the position of the second retaining ring includes biasing the first and second retaining rings apart within the fixed distance.

* * * * *